US010950961B2

(12) United States Patent
Lai et al.

(10) Patent No.: US 10,950,961 B2
(45) Date of Patent: Mar. 16, 2021

(54) CARD EDGE CONNECTOR STRUCTURE

(71) Applicant: JESS-LINK PRODUCTS CO., LTD., New Taipei (TW)

(72) Inventors: Cheng-Chung Lai, New Taipei (TW); Ya-Fen Kao, New Taipei (TW); Tung-Huan Hsieh, New Taipei (TW); Chieh-Ming Cheng, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 16/677,452

(22) Filed: Nov. 7, 2019

(65) Prior Publication Data

US 2020/0328541 A1 Oct. 15, 2020

(30) Foreign Application Priority Data

Apr. 9, 2019 (TW) ..... 10820428.2

(51) Int. Cl.

| | |
|---|---|
| ***H01R 12/72*** | (2011.01) |
| ***H01R 12/71*** | (2011.01) |
| ***H01R 24/60*** | (2011.01) |
| ***H01R 12/70*** | (2011.01) |
| ***H01R 27/02*** | (2006.01) |
| ***H01R 13/40*** | (2006.01) |

(52) U.S. Cl.

CPC ..... *H01R 12/721* (2013.01); *H01R 12/7005* (2013.01); *H01R 12/714* (2013.01); *H01R 13/40* (2013.01); *H01R 24/60* (2013.01); *H01R 27/02* (2013.01)

(58) Field of Classification Search

CPC ..... H01R 12/721; H01R 12/7005; H01R 12/714; H01R 13/40; H01R 24/60; H01R 27/02

USPC ..... 439/79, 108

See application file for complete search history.

(56) References Cited

U.S. PATENT DOCUMENTS

| | | | | |
|---|---|---|---|---|
| 6,971,891 | B1 * | 12/2005 | Huang | H01R 13/4536 439/137 |
| 9,979,136 | B1 * | 5/2018 | Wu | H01R 13/6597 |
| 2005/0048818 | A1 * | 3/2005 | Pan | H01R 23/6873 439/108 |
| 2010/0075538 | A1 * | 3/2010 | Ohshida | H01R 13/514 439/629 |
| 2016/0172780 | A1 * | 6/2016 | Tamai | H01R 12/73 439/733.1 |
| 2017/0033506 | A1 * | 2/2017 | Hsu | H01R 13/6582 |

* cited by examiner

*Primary Examiner* — Hien D Vu

(57) ABSTRACT

A card edge connector structure includes an insulating case, a terminal assembly, a first grounding sheet and a second grounding sheet. The terminal assembly includes a first terminal set and a second terminal set and is configured in the insulating case. The first grounding sheet is configured between the insulating case and the first terminal set, and the second grounding sheet is configured between the insulating case and the second terminal set. A first arm of the first grounding sheet contacts the first grounding terminal through a first groove of a first terminal fixing component, and a second arm of the second grounding sheet contacts the second grounding terminal through a second groove of a second terminal fixing component.

10 Claims, 5 Drawing Sheets

CARD EDGE CONNECTOR STRUCTURE

CROSS-REFERENCE TO RELATED APPLICATION

This application claims priority to and the benefit of Taiwan Patent Application No. 108204282, filed on Apr. 9, 2019, the disclosure of which is incorporated herein by reference in its entirety.

BACKGROUND OF THE INVENTION

1. Field of the Invention

The present invention relates to a card edge connector structure, and more particularly, to a card edge connector structure capable of preventing interference and ensuring the transmission characteristics.

2. Description of the Prior Art

Connectors are connecting components and accessories for electrical signals. The electronic devices translate and transmit signals to each other through cables and connectors. That is to say, the connectors are the communicating bridges for the signals. The connectors are widely applied on the fields of vehicles, computer peripherals and data communications, industries, military and aerospace industries, transportation, consumer electronics, medical treatments, instruments, commercial equipments and so on. Therefore, the connectors play an important role in many fields. In this well developed and efficient generation, the transmission speed of the signal is being developed toward high speed continuously. The high frequency connectors also have been developed to increase the transmission speed of the signal.

However, the connector will be affected easily by external factors, such as electromagnetic interference (EMI), while loading the higher frequency signals. The connector will send incomplete signals due to the electromagnetic interference, and further affect the transmission quality. In addition, the tendency to miniaturize the electronic products follows the development of the electronics industry, so that the conductive terminals inside the connector are getting closer. The pitches between the conductive terminals are reduced to cause disadvantageous for the transmission of high frequency signals, and the crosstalk between the conductive terminals is easily caused. Due to the above interference reasons, the signal transmission characteristics of the connector are affected. In general, the grounding sheet is configured inside the connector and contacts the grounding terminals of the conductive terminals to reduce the influence of electromagnetic interference or crosstalk on the connector.

In the prior art, the grounding sheet can be configured between two rows of conductive terminals of the connector. When the male and female ends of the connector are connected to each other, the two rows of conductive terminals of the female end of the connector are stretched because the circuit board of the male end of the connector is inserted between the two rows of conductive signals. At this time, the grounding sheet may not completely contact the grounding terminals of the conductive terminals to cause poor contact, so that the grounding sheet cannot effectively block the interference to affect the transmission characteristics of the connector. In another prior art, two grounding sheets are configured on the outer sides of two rows of conductive terminals in the connector, and the elastic arms of the grounding sheets contact the elastic parts of the grounding terminals of conductive terminals. The elastic parts of the two rows of conductive signals of the connector and the elastic arms of the grounding sheets are stretched by pressing when the male and female ends of the connector are connected to each other. However, the elastic arms of the grounding sheets may be deformed by pressing after continuous connection and disconnection of the connector, and then cannot fully contact the grounding terminals of the conductive terminals to affect the transmission characteristics of the connector.

Therefore, it is necessary to improve the structure of the connector to ensure that the connector can maintain the transmission characteristics during connection of the connector.

SUMMARY OF THE INVENTION

Therefore, the present invention provides a card edge connector structure to solve the problems in the prior art.

According to an embodiment, the card edge connector structure includes an insulating case, a terminal assembly, a first grounding sheet and a second grounding sheet. The terminal assembly is configured in the insulating case, and includes a first terminal set and a second terminal set. The first terminal set includes a plurality of first signal terminals, at least one first grounding terminal and a first terminal fixing component. The first terminal fixing component includes at least one first groove. The first signal terminals and the at least one first grounding terminal are fixed by the first terminal fixing component and arranged in parallel. The position of the at least one first groove of the first terminal fixing component is corresponding to that of the at least one first grounding terminal to expose a part of the at least one first grounding terminal out of the first terminal fixing component. The second terminal set is configured corresponding to the first terminal set. The second terminal set includes a plurality of second signal terminals, at least one second grounding terminal and a second terminal fixing component. The second terminal fixing component includes at least one second groove. The second signal terminals and the at least one second grounding terminal are fixed by the second terminal fixing component and arranged in parallel. The position of the at least one second groove of the second terminal fixing component is corresponding to that of the at least one second grounding terminal to expose a part of the at least one second grounding terminal out of the second terminal fixing component. The first grounding sheet is configured between the insulating case and the first terminal set. The first grounding sheet includes at least one first elastic arm. The at least one first elastic arm is configured to contact the at least one first grounding terminal through the at least one first groove. The second grounding sheet is configured between the insulating case and the second terminal set. The second grounding sheet includes at least one second elastic arm. The at least one second elastic arm is configured to contact the at least one second grounding terminal through the at least one second groove.

Wherein, each of the first signal terminals, the second signal terminals, the at least one first grounding terminal and the at least one second grounding terminal includes a fixed part and an elastic part. The fixed parts of the first signal terminals and the at least one first grounding terminal are fixed in the first terminal fixing component, and the fixed parts of the second signal terminals and the at least one second grounding terminal are fixed in the second terminal fixing component.

Wherein, the at least one first elastic arm of the first grounding sheet contacts the fixed part of the at least one first grounding terminal, and the at least one second elastic arm of the second grounding sheet contacts the fixed part of the at least one second grounding terminal.

Wherein, the opening of the at least one first groove of the first terminal fixing component faces the first grounding sheet, and the opening of the at least one second groove of the second terminal fixing component faces the second grounding sheet.

Wherein, the arrangement of the first signal terminals and the at least one first grounding terminal of the first terminal set is different from that of the second signal terminals and the at least one second grounding terminal.

Wherein, the arrangement of the at least one first elastic arm of the first terminal sheet is corresponding to that of the at least one first grounding terminal of the first terminal set. The arrangement of the at least one second elastic arm of the second terminal sheet is corresponding to that of the at least one second grounding terminal of the second terminal set.

Wherein, the at least one first elastic arm respectively has one end connected to the first grounding sheet and the other end which is suspended. The at least one second elastic arm respectively has one end connected to the second grounding sheet and the other end which is suspended.

Wherein, the at least one first elastic arm of the first grounding sheet and the at least one second elastic arm of the second grounding sheet respectively have the shape of an I shape, a L shape, a U shape, a circular arc shape and a combination thereof.

Wherein, the contacting normal forces respectively applied by the at least one first elastic arm and the at least one second elastic arm contacting to the at least one first grounding terminal and the at least one second grounding terminal are greater than 15 g.

Wherein, the both ends of the at least one first elastic arm of the first grounding sheet are connected to the first grounding sheet respectively, and the both ends of the at least one second elastic arm of the second grounding sheet are connected to the second grounding sheet respectively.

Wherein, the at least one first elastic arm of the first grounding sheet and the at least one second elastic arm of the second grounding sheet are made by stamping process.

The elastic arms of the grounding sheet of card edge connector structure of the present invention contacts the fixed parts of the grounding terminals of the terminal set stably through the grooves of the terminal fixing component to prevent the interference effectively and maintain the transmission characteristics.

BRIEF DESCRIPTION OF THE APPENDED DRAWINGS

DETAILED DESCRIPTION OF THE INVENTION

Figure 1:
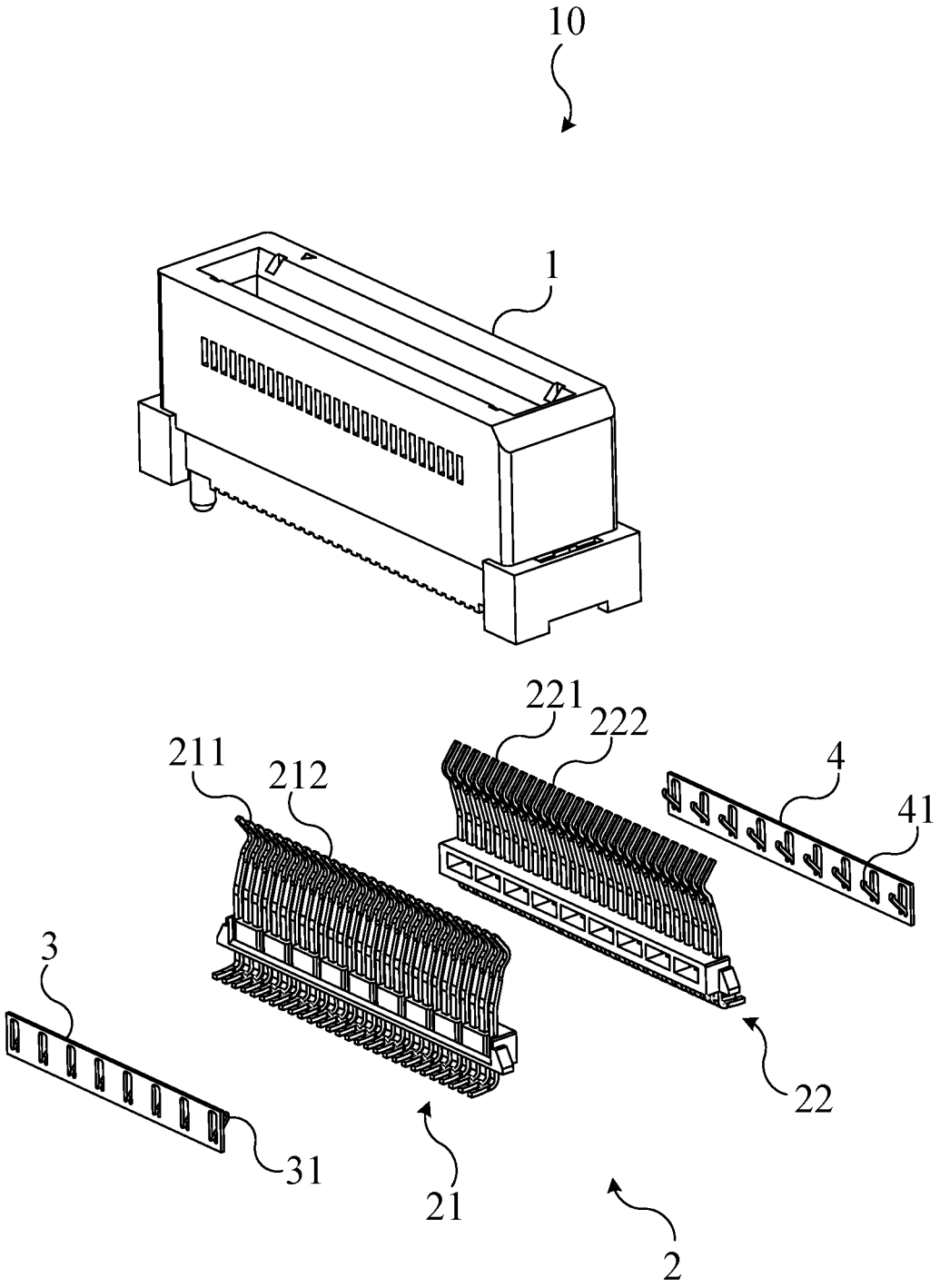
FIG. 1 is an exploded diagram illustrating a card edge connector structure according to an embodiment of the present invention.
Figure 2:
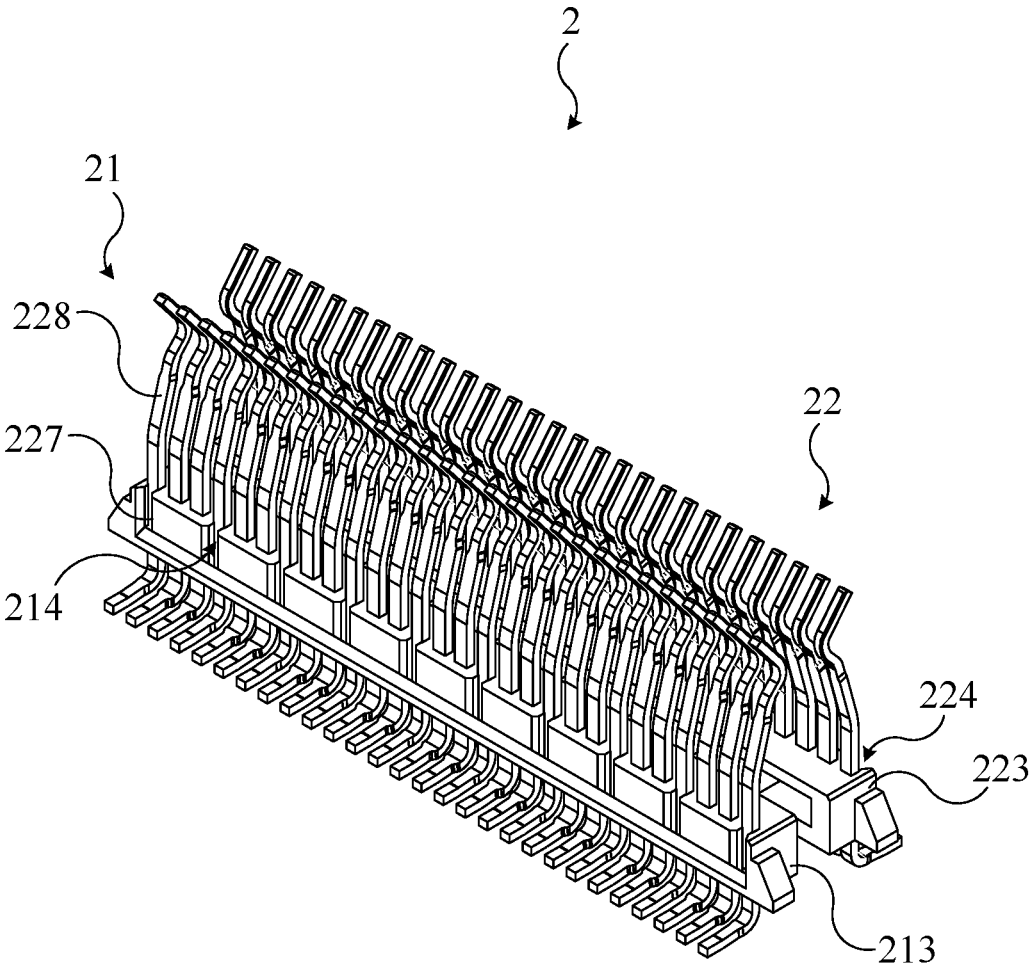
FIG. 2 is a schematic diagram illustrating a terminal assembly of the card edge connector structure in this embodiment.

Please refer to FIG. 1 and FIG. 2. FIG. 1 is an exploded diagram illustrating a card edge connector structure 10 according to an embodiment of the present invention. FIG. 2 is a schematic diagram illustrating a terminal assembly 2 of the card edge connector structure 10 in this embodiment. As shown in FIG. 1, the card edge connector structure 10 of the present invention includes an insulating case 1, a terminal assembly 2, a first grounding sheet 3 and a second grounding sheet 4. The terminal assembly 2 is configured on the insulating case 1 and includes a first terminal set 21 and a second terminal set 22 corresponding to the first terminal set 21. The first grounding sheet 3 is configured between the insulating case 1 and the first terminal set 21 and includes at least one first elastic arm 31. The second grounding sheet 4 is configured between the insulating case 1 and the second terminal set 22 and includes at least one second elastic arm 41. In practice, the arrangement order in the insulating case 1 of the card edge connector structure 10 is the first grounding sheet 3, the first terminal set 21, the second terminal set 22, and the second grounding sheet 4. Therefore, the first grounding sheet 3 and the second grounding sheet 4 can contact the first terminal set 21 and the second terminal set 22 respectively for grounding.

As shown in FIG. 1 and FIG. 2, the first terminal set 21 includes a plurality of first signal terminals 211, at least one first grounding terminal 212 and a first terminal fixing component 213. The first terminal fixing component 213 includes at least one first groove 214. The plurality of first signal terminals 211 and the at least one first grounding terminal 212 are fixed by the first terminal fixing component 213 and arranged in parallel. In practice, the first signal terminals 211 are the communicating terminals for conduction and connection to enable the connector to transmit signals. The first grounding terminal 212 is configured for grounding and dissipating the interference such as the noise signal and electromagnetic radiation. The first signal terminals 211 and the at least one first ground terminal 212 are alternately and parallel arranged in a row, and the first signal terminals 211 and the at least one first ground terminal 212 are fixed by the first terminal fixing component 213 to form the first terminal set 21.

The second terminal set 22 includes a plurality of second signal terminals 221, at least one second grounding terminal 222 and a second terminal fixing component 223. The second terminal fixing component 223 includes at least one second groove 224. The plurality of second signal terminal 221 and the at least one second grounding terminal 222 are fixed by the second terminal fixing component 223 and arranged in parallel. The functions and structures of the second terminal set 22, the second signal terminals 221, the second grounding terminals 222 and the second terminal fixing component 223 are substantially the same as those of the first terminal set 21, the first signal terminals 211, the first grounding terminals 212 and the first terminal fixing component 213, and then they will not be described herein. It should be noticed that the arrangement of the second signal terminals 221 and the at least one second grounding terminal 222 are different from that of the first signal terminals 211 and the at least one first grounding terminals 212 in this embodiment. For example, the first grounding terminals 212 are configured at the first, fifth and seventh positions of the first terminal set 21 respectively, and the second grounding terminals 222 are configured at the second, sixth and eighth positions of the second terminal set 22 respectively. In practice, the positions of the first grounding terminals and the second grounding terminals are not limited thereto. The positions of the second grounding terminals 222 of the second terminal set 22 can be partially or completely the same as those of the first grounding terminals 212 of the first terminal set 21.

As mentioned above, the first signal terminals 211 and the first grounding terminals are fixed by the first terminal fixing component 213 to form the first terminal set 21, and the second signal terminals 221 and the second grounding terminals are fixed by the second terminal fixing component 223 to form the second terminal set 22. In practice, the first terminal fixing component 213 and the second terminal fixing component 223 can be made by molding. The material of the first terminal fixing component 213 and the second terminal fixing component 223 can be an insulating material, such as plastic or rubber. The first terminal fixing component 213 and the second terminal fixing component 223 further fix the fixed part 227 of each terminal. Therefore, the elastic part 228 of each terminal exposed from the first terminal fixing component 213 and the second terminal fixing component 223 can contact other components for transmission.

Furthermore, the first terminal fixing component 213 includes at least one first groove 214, and the second terminal fixing component 223 includes at least one second groove 224. In this embodiment, the position of the first groove 214 of the first terminal fixing component 213 is corresponding to that of the first grounding terminal 212 of the first terminal set 21, and the position of the second groove 224 of the second terminal fixing component 223 is corresponding to that of the second grounding terminal 222 of the second terminal set 22. In practice, the first groove 214 and the second groove 224 can be formed by cutting or molding process. Therefore, the at least one first grounding terminals 212 of the first terminal set 21 is partially exposed from the first terminal fixing component 213, and the at least one second grounding terminal 222 of the second terminal set 22 is exposed from the second terminal fixing component 223. Furthermore, the fixed part 227 of the at least one first grounding terminal 212 of the first terminal set 21 is exposed from the first terminal fixing component 213, and the fixed part 227 of the at least one second grounding terminal 222 of the terminal set 22 is exposed from the second terminal fixing component 223.

In this embodiment, the openings of the first groove 214 and the second groove 224 face the first grounding sheet 3 and the second grounding sheet 4 respectively. Therefore, the first elastic arm 31 of the first grounding sheet 3 and the second elastic arm 41 of the second grounding sheet 4 can contact the fixed part 227 of the first grounding terminal 212 and the second grounding terminal 222 by passing through the first groove 214 and the second groove 223 respectively. Since the fixed parts 227 of the terminals of the first terminal set 21 and the second terminal set 22 are fixed by the first terminal fixing component 213 and the second terminal fixing component 223 and the fixed parts 227 are not easy to be deformed by installing or pressing, the first elastic arm 31 of the first grounding sheet 3 and the second elastic arm 41 of the second grounding sheet 4 can stably contact the first grounding terminal 212 and the second grounding terminal 222 to prevent the interference effectively and maintain the transmission characteristics of the connector.

In practice, the materials of the first grounding sheet 3 and the second grounding sheet 4 can be conductive metal. The first elastic arm 31 and the second elastic arm 41 are vertically protruded from the plane of the first grounding sheet 3 and the second grounding sheet 4 respectively. Therefore, the first elastic arm 31 and the second elastic arm 41 contact the first grounding terminal 212 and the second grounding terminal 222 through the first groove 214 and the second groove 224 respectively after assembling the card edge connector structure 10. In this embodiment, in addition to the positions of the first groove 214 of the first terminal fixing component 213 and the second groove 224 of the second terminal fixing component 223 corresponding to those of the first grounding terminal 212 of the first terminal set 21 and the second grounding terminal 222 of the second terminal set 22 respectively, the arrangements of the first elastic arm 31 of the first grounding sheet 3 and the second elastic arm 41 of the second grounding sheet 4 are corresponding to those of the first grounding terminal 212 of the first terminal set 21 and the second grounding terminal 222 of the second terminal set 22 respectively.

Since the first elastic arm 31 of the first grounding sheet 3 and the second elastic arm 41 of the second grounding sheet 4 contact the fixed parts 227 of the first grounding terminal 212 and the second grounding terminal 222 respectively, and the first terminal fixing component 213 and the second terminal fixing component 223 fix the fixed parts 227 of the grounding terminal 212 and the second grounding terminal 222, the deformations of the fixed parts 227 of the first grounding terminal 212 and the second grounding terminal 222 are smaller than those of the elastic parts 228 of the first grounding terminal 212 and the second grounding terminal 222 when the male and female ends of the connector are connected to each other, so that the first elastic arm 31 of the first grounding sheet 3 and the second elastic arm 41 of the second grounding sheet 4 can contact the first grounding terminal 212 and the second grounding terminal 222 more stably, thereby preventing interference effectively.

Each of the terminal of the terminal assembly is pressed during the connection or disconnection of the connector. The deformations of the terminals may occur after a certain number of times of connection or disconnection, resulting in poor contact of the grounding arm of the grounding sheet. Therefore, the elastic arm of the grounding sheet is usually designed to be deformed to contact the grounding terminal when the connecter is assembled, so as to ensure the stable contact between the elastic arm of the grounding sheet and the grounding terminal. In this embodiment, the contacting normal forces respectively applied on the first grounding terminal 212 and the second grounding terminal 222 by the first elastic arm 31 and the second elastic arm 41 are greater than 15 g.

Figure 3A:
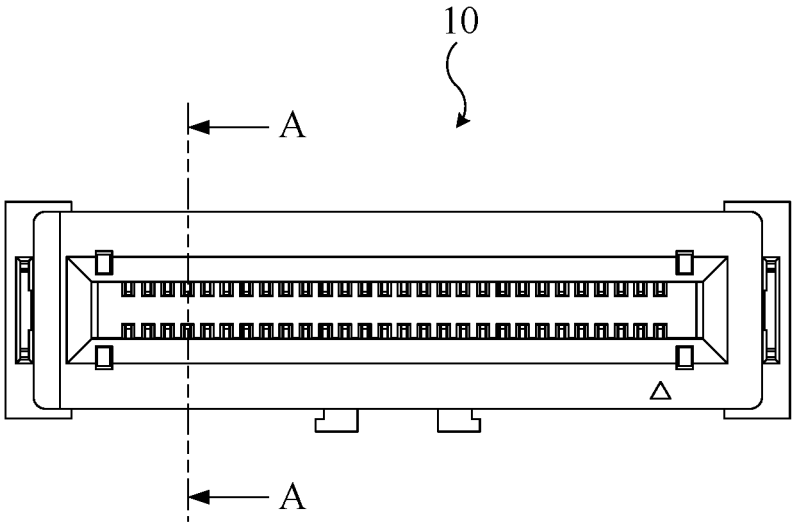
FIG. 3A is a top view diagram illustrating the card edge connector structure according to an embodiment of the present invention.
Figure 3B:
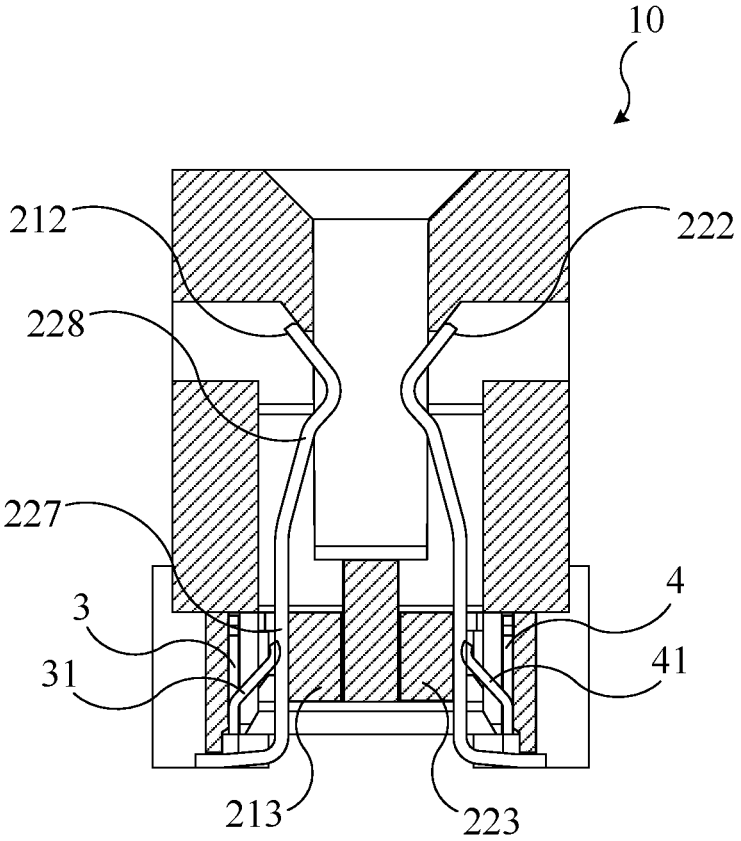
FIG. 3B is a sectional diagram along the line A-A in the FIG. 3A.
Figure 4:
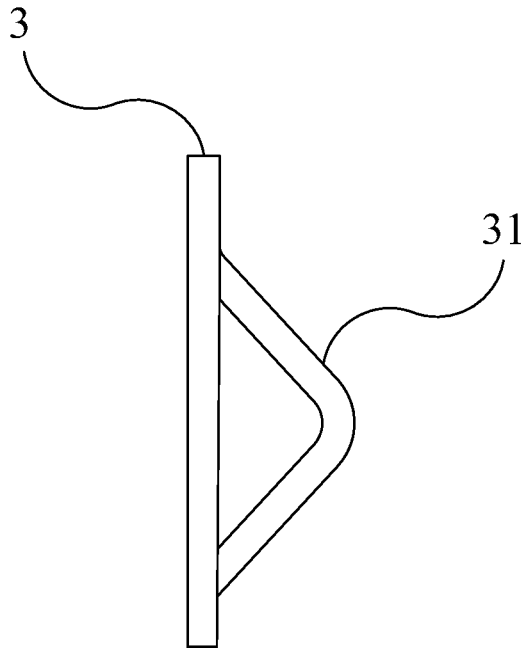
FIG. 4 is a schematic diagram of a first grounding sheet of the card edge connector structure according to another embodiment of the present invention.

Please refer to FIG. 3A, FIG. 3B and FIG. 4. FIG. 3A is a top view diagram illustrating the card edge connector structure 10 according to an embodiment of the present invention. FIG. 3B is a sectional diagram along the line A-A in the FIG. 3A. FIG. 4 is a schematic diagram of the first grounding sheet 3 of the card edge connector structure 10 according to another embodiment of the present invention. As shown in FIG. 3A and FIG. 3B, the first elastic arm 31 of the first grounding sheet 3 has one end connected to the first grounding sheet 3 and other end which is suspended, and the second elastic arm 41 of the second grounding sheet 4 has one end connected to the second grounding sheet 4 and other end which is suspended.

In this embodiment, the positions of the ends connected the elastic arm 31, 41 of the grounding sheet 3, 4 are, but not limited to, on the lower side of the grounding sheet 3, 4 after the card edge connector structure 10 is assembled, that is, the positions of the ends connected the elastic arm 31, 41 of the grounding sheet 3, 4 are near the fixed part 227 of the terminals. In practice, the positions of one end connected the elastic arm 31, 41 of the grounding sheet 3, 4 also can be configured on the upper side of the grounding sheet 3, 4. As shown in FIG. 4, in this embodiment, both ends of the first elastic arm 31 of the first grounding sheet 3 can be connected to the first grounding sheet 3, and both ends of the second elastic arm 41 of the second grounding sheet 4 can be connected to the second grounding sheet 4 (not shown in FIG. 4).

In another embodiment, both of the first elastic arm 31 of the first grounding sheet 3 and the second elastic arm 41 of the second grounding sheet 4 can be integrated by stamping process. In another embodiment, the first grounding sheet 3 includes a first grounding sheet body and a first grounding shrapnel, and the second grounding sheet 4 includes a second grounding sheet body and a second grounding shrapnel. The first grounding shrapnel and the second grounding shrapnel are assembled on the first grounding sheet body and the second grounding sheet body respectively.

Figure 5:
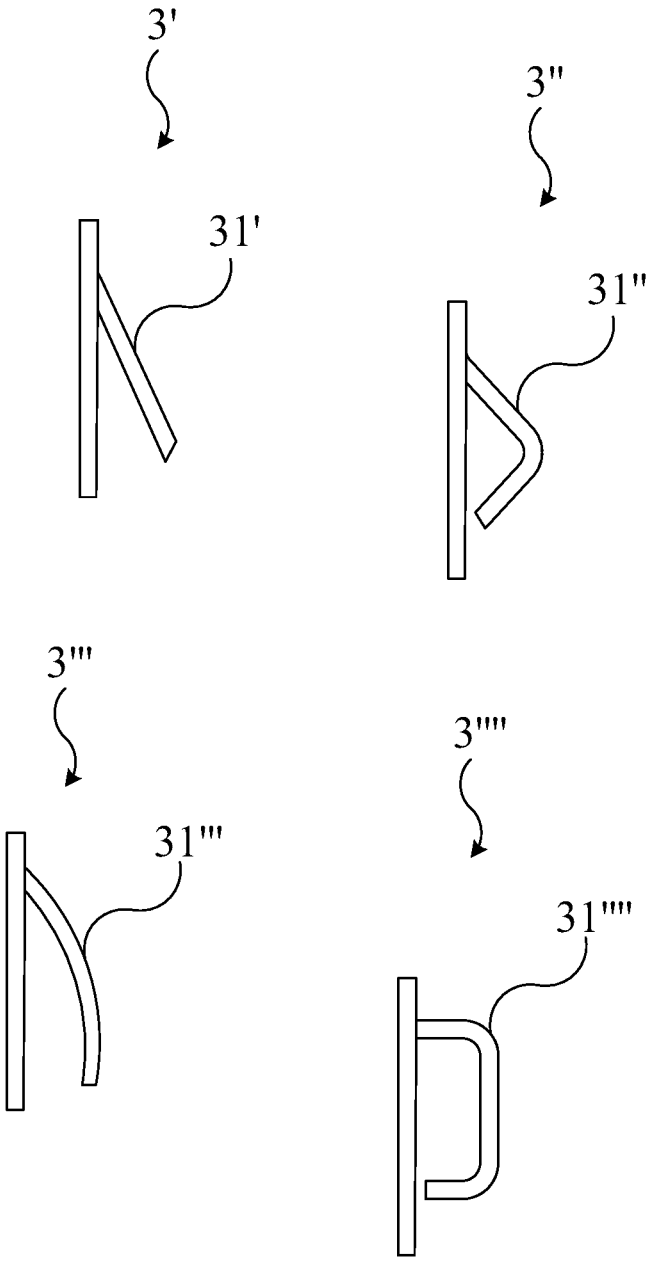
FIG. 5 is a schematic diagram of the first grounding sheets of the card edge connector structure according to one embodiment of the present invention.

Please refer to FIG. 5. FIG. 5 is a schematic diagram of the first grounding sheets 3', 3", 3''' and 3'''' of the card edge connector structure 10 according to one embodiment of the present invention. In the embodiment, the shapes of the first elastic arms 31', 31", 31''' and 31'''' of the first grounding sheet 3', 3", 3''' and 3'''' and the second elastic arms of the second grounding sheet can be an I shape, a L shape, a U shape, a circular arc shape or a combination thereof. In practice, the elastic arms with L shape, U shape and circular arc shape can have one end connected to the grounding sheet and the other end which is suspended, and also can have both ends connected to the grounding sheet.

In summary, the elastic arms of the grounding sheet of card edge connector structure of the present invention contact the fixed parts of the grounding terminals of the terminal set stably through the grooves of the terminal fixing component to prevent the interference effectively and maintain the transmission characteristics.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A card edge connector structure, comprising:

an insulating case;

a terminal assembly configured in the insulating case, the terminal assembly further comprising:

a first terminal set comprising a plurality of first signal terminals, at least one first grounding terminal and a first terminal fixing component, the first terminal fixing component comprising at least one first groove, the first signal terminals and the at least one first grounding terminal being fixed by the first terminal fixing component and arranged in parallel, and the position of the at least one first groove of the first terminal fixing component being corresponding to that of the at least one first grounding terminal to expose a part of the at least one first grounding terminal out of the first terminal fixing component; and a second terminal set configured corresponding to the first terminal set, the second terminal set comprising a plurality of second signal terminals, at least one second grounding terminal and a second terminal fixing component, the second terminal fixing component comprising at least one second groove, the second signal terminals and the at least one second grounding terminal being fixed by the second terminal fixing component and arranged in parallel, and the position of the at least one second groove of the second terminal fixing component being corresponding to that of the at least one second grounding terminal to expose a part of the at least one second grounding terminal out of the second terminal fixing component;

a first grounding sheet configured between the insulating case and the first terminal set, the first grounding sheet comprising at least one first elastic arm, the at least one first elastic arm being configured to contact the at least one first grounding terminal through the at least one first groove; and a second grounding sheet configured between the insulating case and the second terminal set, the second grounding sheet comprising at least one second elastic arm, the at least one second elastic arm being configured to contact the at least one second grounding terminal through the at least one second groove;

wherein each of the first signal terminals, the second signal terminals, the at least one first grounding terminal and the at least one second grounding terminal comprises a fixed part and an elastic part, the fixed parts of the first signal terminals and the at least one first grounding terminal are fixed in the first terminal fixing component, and the fixed parts of the second signal terminals and the at least one second grounding terminal are fixed in the second terminal fixing component, and the elastic parts of the first signal terminals, the at least one first grounding terminal, the second signal terminals and the at least one second grounding terminal are extended upwardly from the first terminal fixing component and the second terminal fixing component respectively.

2. The card edge connector structure of claim 1, wherein the at least one first elastic arm of the first grounding sheet contacts the fixed part of the at least one first grounding terminal, and the at least one second elastic arm of the second grounding sheet contacts the fixed part of the at least one second grounding terminal.

3. The card edge connector structure of claim 1, wherein an opening of the at least one first groove of the first terminal fixing component faces the first grounding sheet, and an opening of the at least one second groove of the second terminal fixing component faces the second grounding sheet.

4. The card edge connector structure of claim 1, wherein an arrangement of the first signal terminals and the at least one first grounding terminal of the first terminal set is different from that of the second signal terminals and the at least one second grounding terminal.

5. The card edge connector structure of claim 4, wherein the arrangement of the at least one first elastic arm of the first terminal sheet is corresponding to that of the at least one first grounding terminal of the first terminal set, and the arrangement of the at least one second elastic arm of the second terminal sheet is corresponding to that of the at least one second grounding terminal of the second terminal set.

6. The card edge connector structure of claim 1, wherein the at least one first elastic arm respectively has one end connected to the first grounding sheet and respectively has the other end which is suspended, and the at least one second elastic arm respectively has one end connected to the second grounding sheet and respectively has the other end which is suspended.

7. The card edge connector structure of claim 1, wherein both ends of the at least one first elastic arm of the first grounding sheet are connected to the first grounding sheet respectively, and the both ends of the at least one second elastic arm of the second grounding sheet are connected to the second grounding sheet respectively.

8. The card edge connector structure of claim 1, wherein the at least one first elastic arm of the first grounding sheet and the at least one second elastic arm of the second grounding sheet are made by stamping process.

9. The card edge connector structure of claim 1, wherein the at least one first elastic arm of the first grounding sheet and the at least one second elastic arm of the second grounding sheet respectively have the shape of an I shape, a L shape, a U shape, a circular arc shape and a combination thereof.

10. The card edge connector structure of claim 1, wherein contacting normal forces respectively applied by the at least one first elastic arm and the at least one second elastic arm contacting to the at least one first grounding terminal and the at least one second grounding terminal are greater than 15 g.

* * * * *